US007994447B2

(12) United States Patent
Sakai

(10) Patent No.: US 7,994,447 B2
(45) Date of Patent: Aug. 9, 2011

(54) PUSH BUTTON SWITCH DEVICE

(75) Inventor: Takayuki Sakai, Osaka (JP)

(73) Assignee: Idec Corporation, Osaka (JP)

( * ) Notice: Subject to any disclaimer, the term of this patent is extended or adjusted under 35 U.S.C. 154(b) by 307 days.

(21) Appl. No.: 12/310,589

(22) PCT Filed: Aug. 21, 2007

(86) PCT No.: PCT/JP2007/066163

§ 371 (c)(1),
(2), (4) Date: Feb. 27, 2009

(87) PCT Pub. No.: WO2008/026474

PCT Pub. Date: Mar. 6, 2008

(65) Prior Publication Data

US 2010/0224471 A1 Sep. 9, 2010

(30) Foreign Application Priority Data

Aug. 29, 2006 (JP) ..... 2006-231756

(51) Int. Cl.
*H01H 3/02* (2006.01)

(52) U.S. Cl. ..... 200/529; 200/345

(58) Field of Classification Search ..... 200/529, 200/520, 345, 344, 339, 509, 510, 244
See application file for complete search history.

(56) References Cited

U.S. PATENT DOCUMENTS 3,731,030 A * 5/1973 Holzer ..... 200/529
3,931,487 A * 1/1976 Russenberger ..... 200/529
5,725,088 A * 3/1998 Aimi ..... 200/542

FOREIGN PATENT DOCUMENTS

| | | |
|---|---|---|
| JP | 61-113345 | 7/1986 |
| JP | 5-266754 | 10/1993 |
| JP | 07-245035 | 9/1995 |
| JP | 2004-119238 | 4/2004 |

* cited by examiner

*Primary Examiner* — Felix O Figueroa
(74) *Attorney, Agent, or Firm* — Jordan and Hamburg LLP

(57) ABSTRACT

Upward urging force by operation force of a tact switch and restoring force of a rubber body are applied to an operation body via a pressing body. Then, pressing operation of a push button section causes the operation body to press down the rear ends of left and right sections of the pressing body. This follows that, with both contact sections in contact with a step section functioning as the support points, an operation section on the front end of the pressing body is pressed up to turn on the tact switch. In this process, when the push button section is pressed, the center of rotation of the operation body is changed depending on which portion of the push button section is pressed, causing the distance between a pressed portion of the operation body and the center of the rotation are almost equal independent of which portion is pressed. As a result, the load to operate the push button section is substantially equalized independent of which portion of the operation body is pressed. Also, the load to operate the operation body can be changed as desired by changing the position of the step section which is to be in contact with both contact sections functioning as the support point for the pressing body.

8 Claims, 11 Drawing Sheets

RELATED ART

PUSH BUTTON SWITCH DEVICE

BACKGROUND OF THE INVENTION

The present invention relates to a push button switch device wherein a switch element switched on or off by a downward pressing operation of a push button section is shifted from the center of the push button section toward one end thereof. Particularly, the invention relates to a push button switch device applicable to a case, for example, where an interior of a switch case is illuminated to indicate an operation state of the switch device.

The push button switch device applied to the case where the operation state thereof is indicated by the illumination of the interior of the switch case is conventionally arranged as shown in FIG. 12, for example. As shown in FIG. 12, a switch case 1 is provided with a printed wiring board 3 on a lower side thereof. A light emitting diode (hereinafter, referred to as "LED") 5 is mounted on an upper face of the printed wiring board 3. A reflector 7 having a reflection surface defining a periphery shaped like a truncated cone for upward reflection of light from the LED 5 is disposed in the switch case 1 along with the LED 5 and is located substantially centrally of the case. A built-in switch 9 comprising a tact switch, for example, is mounted on the printed wiring board 3 at place rightward of the reflector 7.

An operation body 13 having a push button 11 removably attached thereto is disposed to close an upper side of the switch case 1. The operation body 13 is bodily pressed down by pressing down on the push button 11. The depressed operation body 13 presses down a switch portion 9*a* on an upper side of the built-in switch 9 via a flexible rubber body 15 whereby the built-in switch 9 is turned on.

A left end 13*a* of the operation body 13 is seated on a step section 17 at a left end of the switch case 1 so as to be locked to a lower face of a locking projection 19 at an upper left end of the switch case 1. On the other hand, a hook portion 13*b* integrally extending downwardly from a lower face of a right end of the operation body 13 is removably engaged with a lower face of an engaging portion 21 formed at a right end of the switch case 1 and having an L-shape in section.

An upward urging force derived from the elasticity of the rubber body 15 is applied to the operation body 13. When the operation body 13 is pressed down against the urging force by pressing down the push button 11, the hook portion 13*b* at the right end of the operation body 13 is rotated downward about the left end 13*a* of the operation body 13, as indicated by an arrow in FIG. 12. The left end 13*a* of the operation body functions as a support point. Hence, a lower side of the right end of the operation body 13 presses on the rubber body 15 to push down the switch portion 9*a* of the built-in switch 9 whereby the built-in switch 9 is turned on.

When the push button 11 is released from the pressing operation, the hook portion 13*b* at the right end of the operation body 13 rotates upward due to the elasticity of the rubber body 15. Hence, the hook portion 13*b* at the right end of the operation body 13 is re-engaged with the engaging portion 21 of the switch case 1 so that the operation body 13 is returned to the initial state.

It is noted that the urging force may also be applied to the operation body 13 by any other urging means than the rubber body 15. The urging means is exemplified by a spring and the like.

Another example of such a push button switch device is designed to operate as follows. When the push button is pressed down, a first end of the push button abuts against a contact member while a second end of the push button is rotated about the first end thereof, as a support point, so as to operate the switch (see, for example, Patent Document 1).

Still another example of the push button switch device is designed as follows. A push button body is provided with a pair of support shafts on a lower side thereof. A double-folded spring member is locked to these support shafts such that a folded portion of the spring member may pressingly operate the switch. The push button body, whatever part of which is pressed down, can be moved down as rotated about a support point defined by a part of the folded portion of the spring member (see, for example, Patent Document 2).

Patent Document 1: Japanese Unexamined Patent Publication No. 2004-119238 (Paragraph 0012, FIG. 2)

Patent Document 2: Japanese Unexamined Patent Publication No. H5 (1993)-266754 (Paragraphs 0022, 0023, 0026, FIG. 8, FIG. 9)

SUMMARY OF THE INVENTION

However, these conventional push button switches have the following problem. Since the push button or the push button body pressingly operated is supported on only one support point, distance between a pressed portion of the push button or push button body and the support point varies greatly depending upon what portion of the push button or push button body is pressed. In consequence, difference between an operating load on place farther away from the support point and an operating load on place closer to the support point is increased so much that the operating load increased or decreased depending upon the pressed portion makes a switch operator feel odd.

In view of the foregoing problem, the invention seeks to provide a push button switch device arranged to substantially equalize the operating load irrespective of the pressed portion of the operation body or the push button section and to permit the operating load to be changed as desired.

In accordance with a first aspect of the invention for solving the above problem, a push button switch device wherein a switch element switched on or off by a downward pressing operation of a push button section is disposed in a switch case as shifted toward a first end from the center of the push button section, the push button switch device comprises: an operation body which is disposed in the switch case and is movable upward or downward as interlocked with the pressing operation of the push button section or with a releasing operation thereof, a plurality of engagement portions of which are formed on edges thereof and are engaged with edges of the switch case in order to prevent disengagement from the switch case, and a pressed portion of which is rotated downward about the engagement portion(s) that corresponds to the pressed portion when the pressing operation is performed; a pressing body which is disposed in the switch case at place under the operation body, which is oscillatably supported on a support point located at any position between first and second ends thereof for seesaw movement between the first and second ends thereof, and which presses the switch element by means of the first end thereof moved upward; urging means for urging downward the first end of the pressing body and for urging upward the second end thereof; and a contact section which abuts against the second end of the pressing body as formed substantially centrally of a lower side of the operation body, and which moves down the second end of the pressing body against the urging force of the urging means as driven by the downward movement of the operation body interlocked with the pressing operation of the push button section.

In accordance with a second aspect of the invention, a push button switch device is characterized in that the urging means is the switch element and the urging force derives from an operation force on the switch element.

In accordance with a third aspect of the invention, a push button switch device is characterized in that a flexible rubber body covering the switch element is interposed between the switch element and the first end of the pressing body and that the urging means is the rubber body and the urging force derives from a restoring force of the rubber body.

In accordance with a fourth aspect of the invention, a push button switch device is characterized in that a projection is provided at the switch case or the pressing body and the position of the projection defines the support point of the pressing body.

In accordance with a fifth aspect of the invention, a push button switch device is characterized in that the position of the projection can be shifted in a direction toward the first end of the pressing body and in a direction toward the second end thereof or can be fixed to place.

In accordance with a sixth aspect of the invention, a push button switch device is characterized in that the operation body has a generally rectangular configuration and the plural engagement portions are formed at the four corners of the operation body.

In accordance with a seventh aspect of the invention, a push button switch device further comprises a circuit board disposed in the switch case on a first-end side thereof and having the switch element and a light emitting device mounted thereon, and an optical guiding member for guiding light from the light emitting device to the push button section.

In accordance with an eighth aspect of the invention, a push button switch device further comprises: a backside cover mounted to a back side of the switch case in a manner to be slidable in opposite directions parallel to the back side of the switch case and to be removable from the switch case; a first hook body for mounting/retaining switch device which is integrated with a first end of the backside cover with respect to a sliding direction thereof; a second hook body formed at a second end of the switch case with respect to the sliding direction; and an urging body disposed between the back side of the switch case and the backside cover and urging the backside cover relative to the switch case in one way of the sliding direction.

According to the first aspect of the invention, the contact section at the center of the lower side of the operation body abuts against the pressing body. Therefore, in a state where the push button section is not pressingly operated, the operation body receives an upward urging force from the urging means via the pressing body. Hence, a separate urging body, such as a spring, for urging the operation body upward is not required so that the number of components is reduced to simplify the construction.

The second end of the pressing body is pressed downward by the contact section of the operation body so moved down, while the first end of the pressing body, which is on the opposite side of the support point from the second end, is pushed upward so as to press on the switch element, which is turned on or off. At this time, the second end, support point and first end of the pressing body respectively act as a power point, a support point and a working point of a lever. The operation force on the switch (operating load) is of a constant value specific to the switch and hence, the load to be applied to the second end can be changed by properly setting the position of the support point.

More specifically, if the support point is shifted toward the second end (power point) of the pressing body, the required load on the second end of the pressing body for pressingly turning on or off the switch is increased. Conversely, if the support point is shifted toward the first end (working point) of the pressing body, the required load on the second end of the pressing body for pressingly turning on or off the switch is decreased.

Thus, the switch operating load can be changed as needed by merely shifting the position of the support point of the pressing body.

When the push button section is pressingly operated, the pressed portion of the operation body is rotated downward against the urging force as interlocked with the pressing operation, or rotated about the engagement portion corresponding to the pressed portion of the operation body.

Accordingly, the center of rotation is changed according to the pressed portion of the operation body so that a distance between the pressed portion and the support point is made substantially constant whatever part of the operation body is pressed down. In contrast to the conventional device having one fixed support point, the invention can substantially equalize the operating load irrespective of the pressed portion of the operation body.

According to the second aspect of the invention, the switch element is used as the urging means and the operation force on the switch element is applied as the urging force to the operation body by means of the pressing body. This of course negates the need for providing a separate urging body to urge the operation body nor for providing a spring or the like as the urging means. Hence, the number of components can be reduced further.

The third aspect of the invention takes advantage of the restoring force of the flexible rubber body. This approach does not entail the size increase of the device and is quite effective in a case where the operation force on the switch is too small to be used as the urging force to be applied to the operation body by means of the pressing body.

According to the fourth aspect of the invention, the pressing body can be assuredly brought into the oscillatory movement by pressing on the operation body because the projection provided at the switch case or the pressing body serves as the support point of the pressing body.

According to the fifth aspect of the invention, the position of the projection provided at the switch case or the pressing body can be shifted and fixed to a suitable place. Accordingly, the load to be applied to the second end of the pressing body can be easily changed according to operator's preferences or conveniences at a site where the device is installed.

According to the sixth aspect of the invention, the operation body is formed with the plural engagement portions at the four corners thereof, so that the distance between the pressed portion of the operation body and the center of rotation thereof can be substantially equalized irrespective of the pressed portion. Thus is ensured the consistency of the operating load.

According to the seventh aspect of the invention, the switch element and the light emitting device are mounted on the same circuit board, and the light from the light emitting device is guided to the push button section by means of the optical guiding member. Therefore, the switch device of the invention is less prone to size increase as compared with a case where the light emitting device is mounted on a different circuit board from that of the switch element and is disposed under the push button section or where the light emitting device is disposed at place except under the push button section and away from the position of the switch element. Thus is provided the push button switch device having a lower profile.

According to the eighth aspect of the invention, the push button switch device may be fixed to a predetermined mounting position of a fixing member as follows. The backside cover with the first hook body engaged with a mounting portion on the opposite side is slidably moved relative to the switch case against the urging force of the urging body while the second hook body of the switch case is engaged with a mounting portion. In this manner, the push button switch device can be easily mounted to the predetermined position. Accordingly, the installation of the switch device is accomplished quite easily.

DETAILED DESCRIPTION OF THE INVENTION

Figure 1:
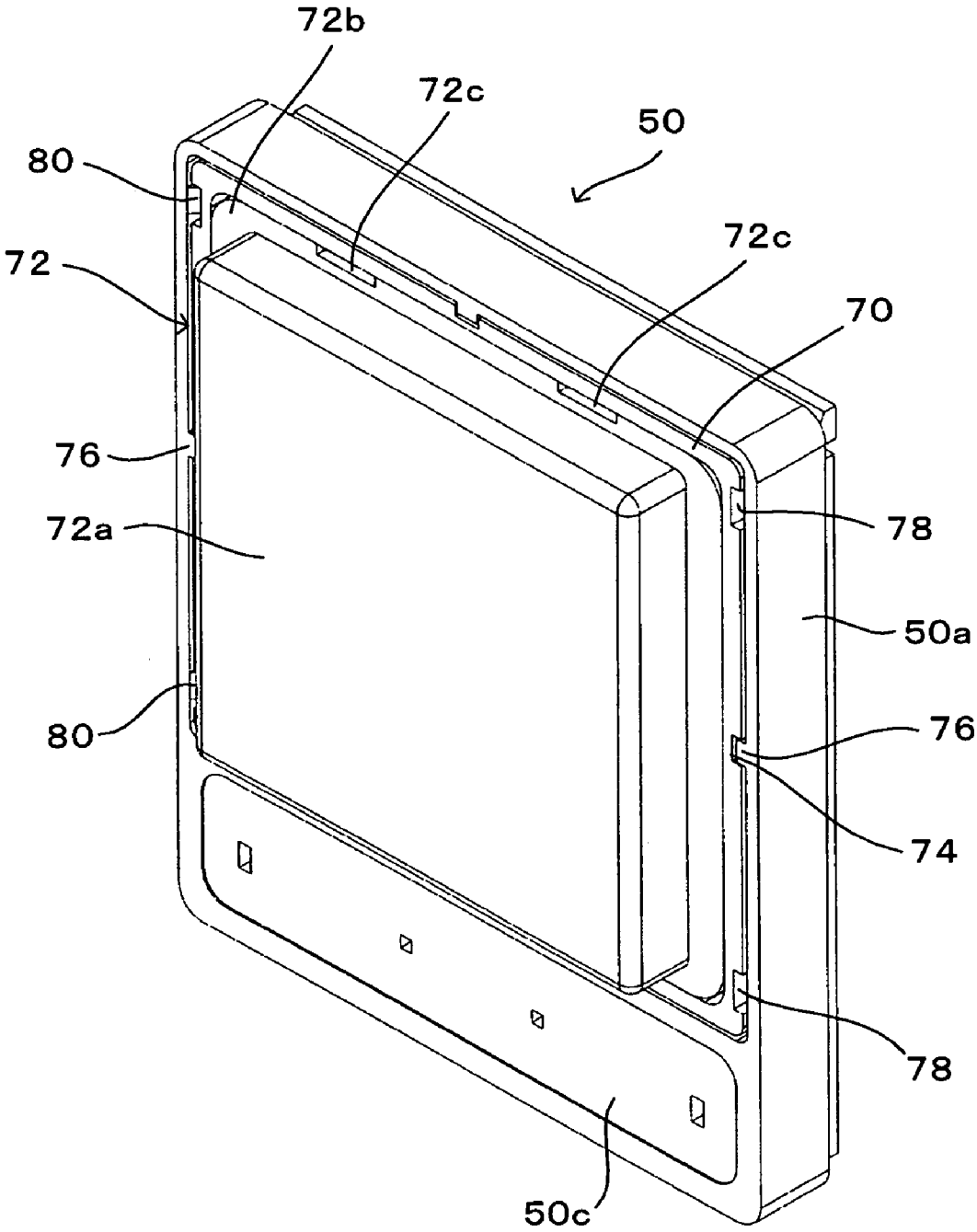
FIG. 1 is an external perspective view showing one embodiment of the invention.
Figure 2:
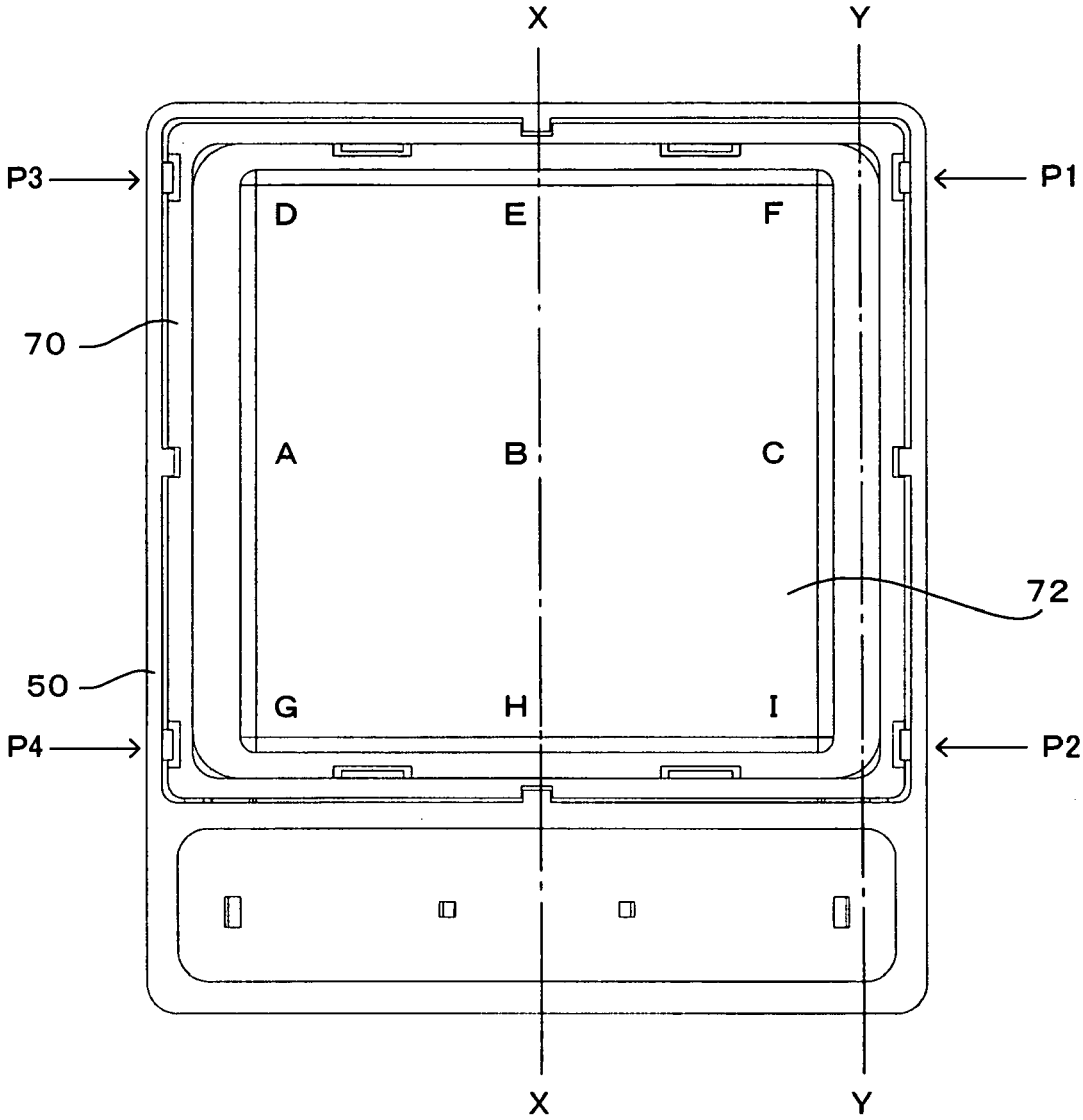
FIG. 2 is a plan view of the one embodiment hereof.
Figure 3:
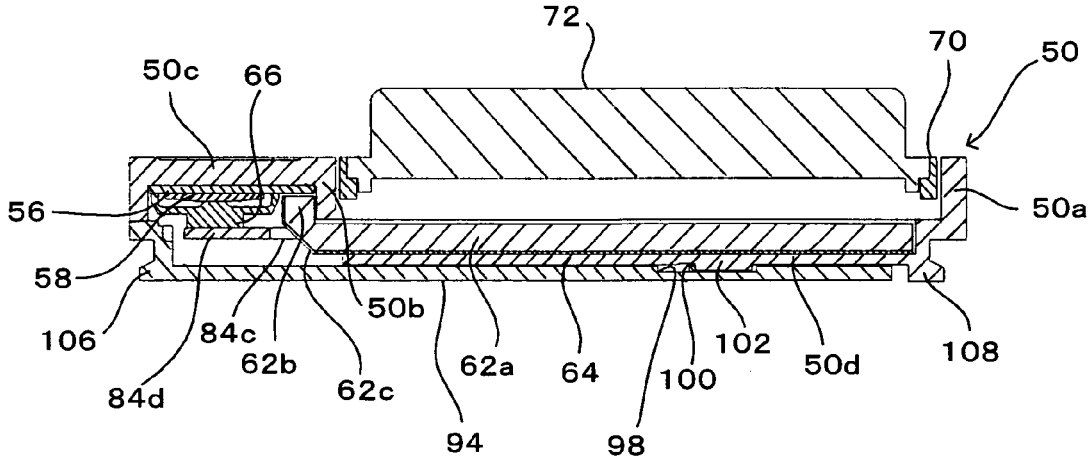
FIG. 3 is a right side view of section taken on the line X-X in FIG. 2.
Figure 4:
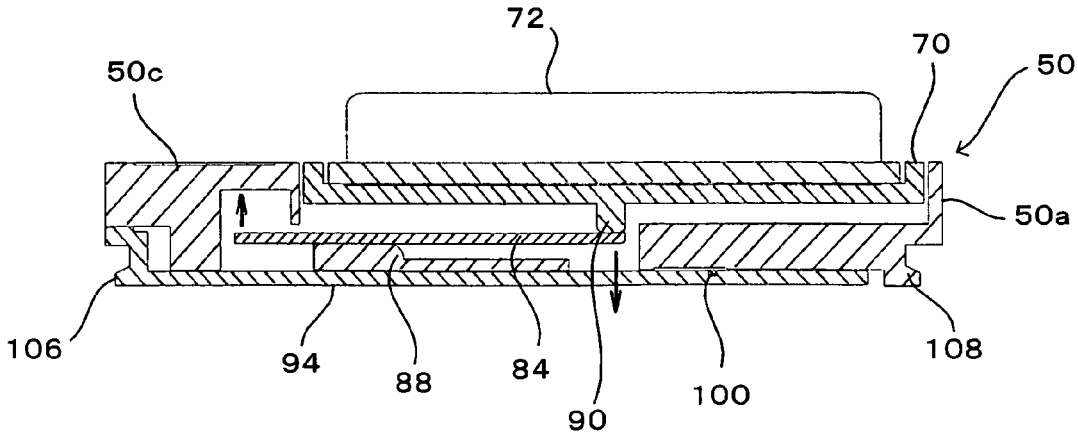
FIG. 4 is a right side view of a section taken on the line Y-Y in FIG. 2.
Figure 5:
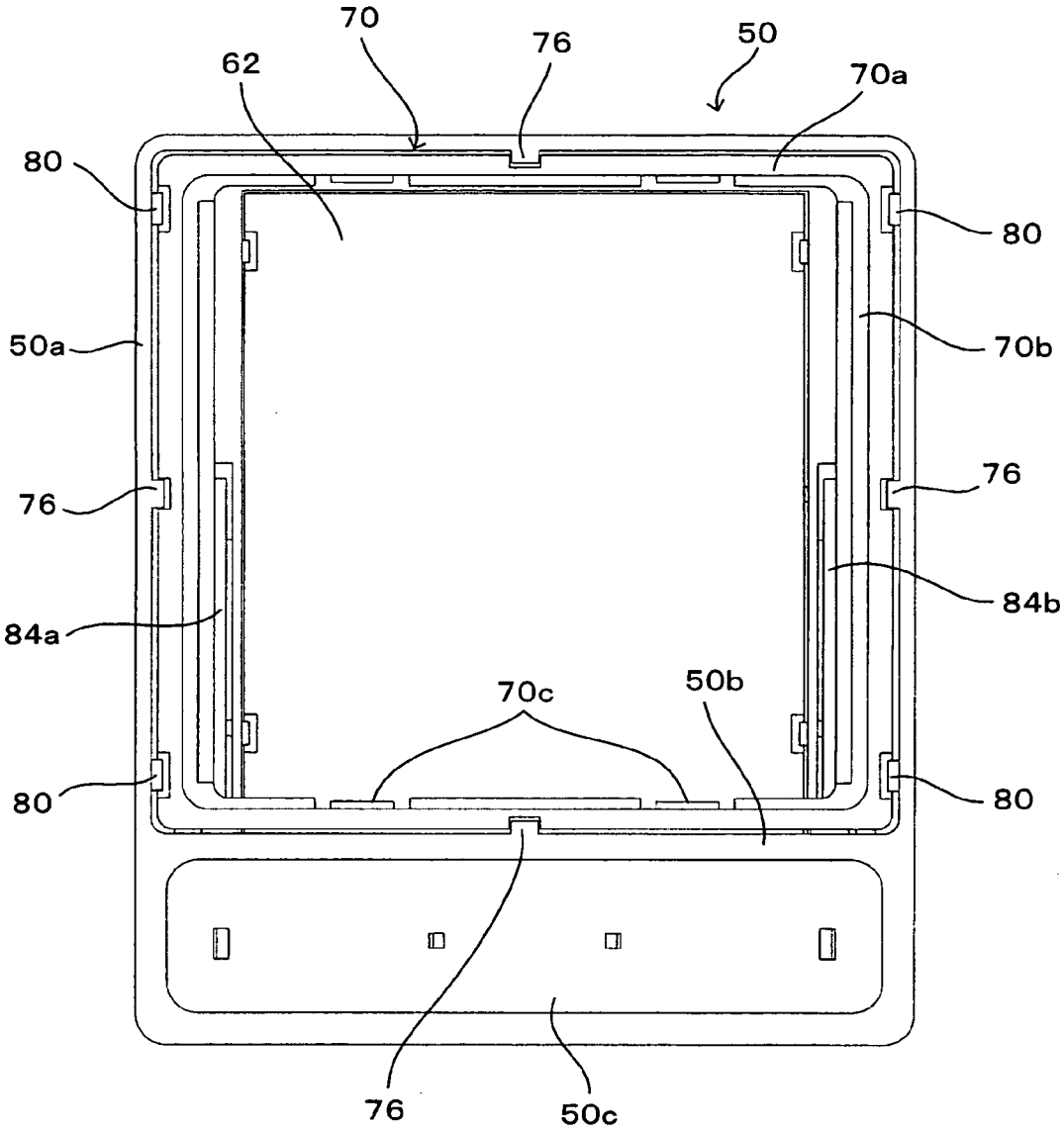
FIG. 5 is a plan view showing an internal structure of the one embodiment removed of a push button section.
Figure 6:
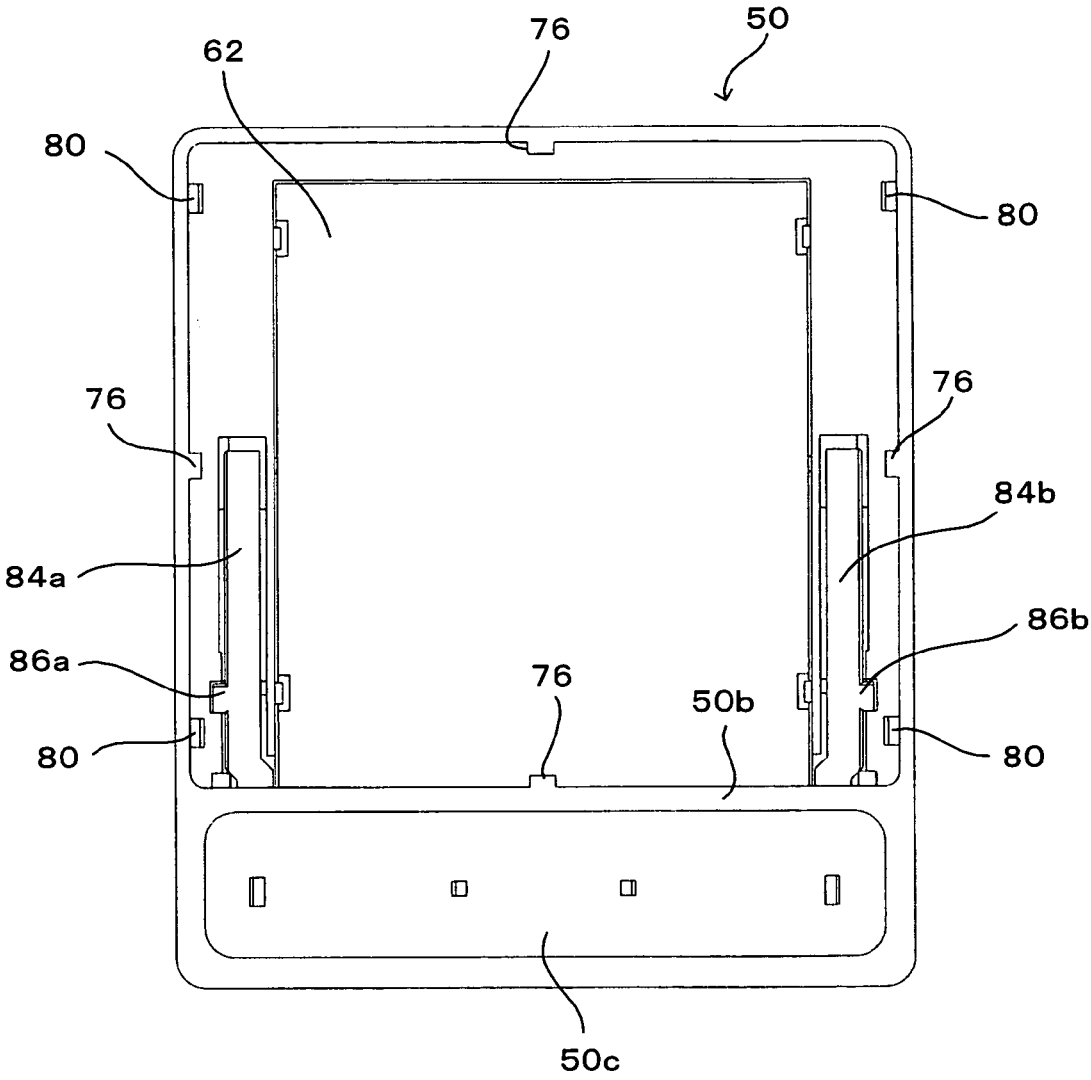
FIG. 6 is a plan view showing the internal structure of FIG. 5 further removed of an operation body.
Figure 7:
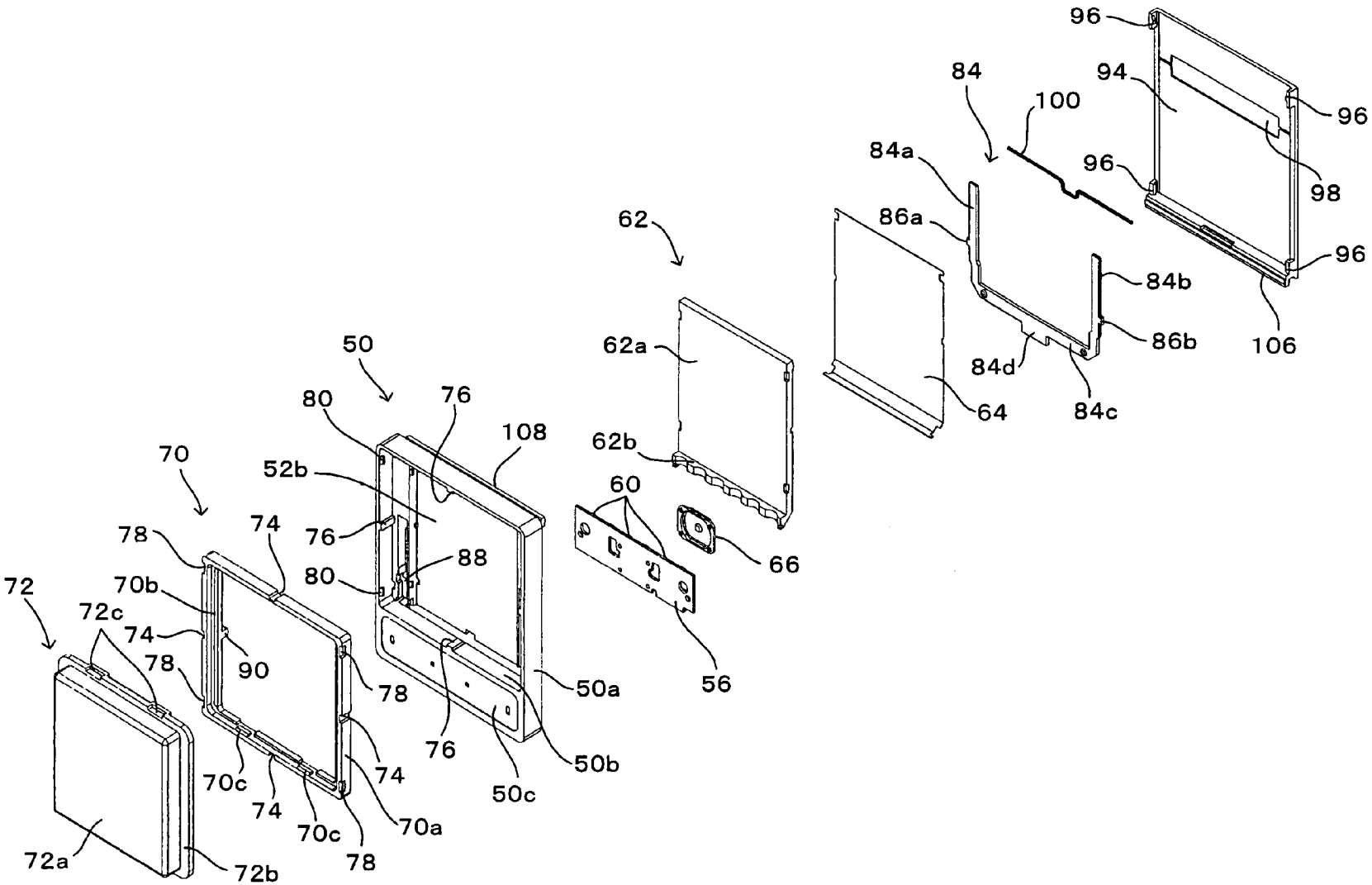
FIG. 7 is a disassembled perspective view of the one embodiment obliquely seen from up above.
Figure 8:
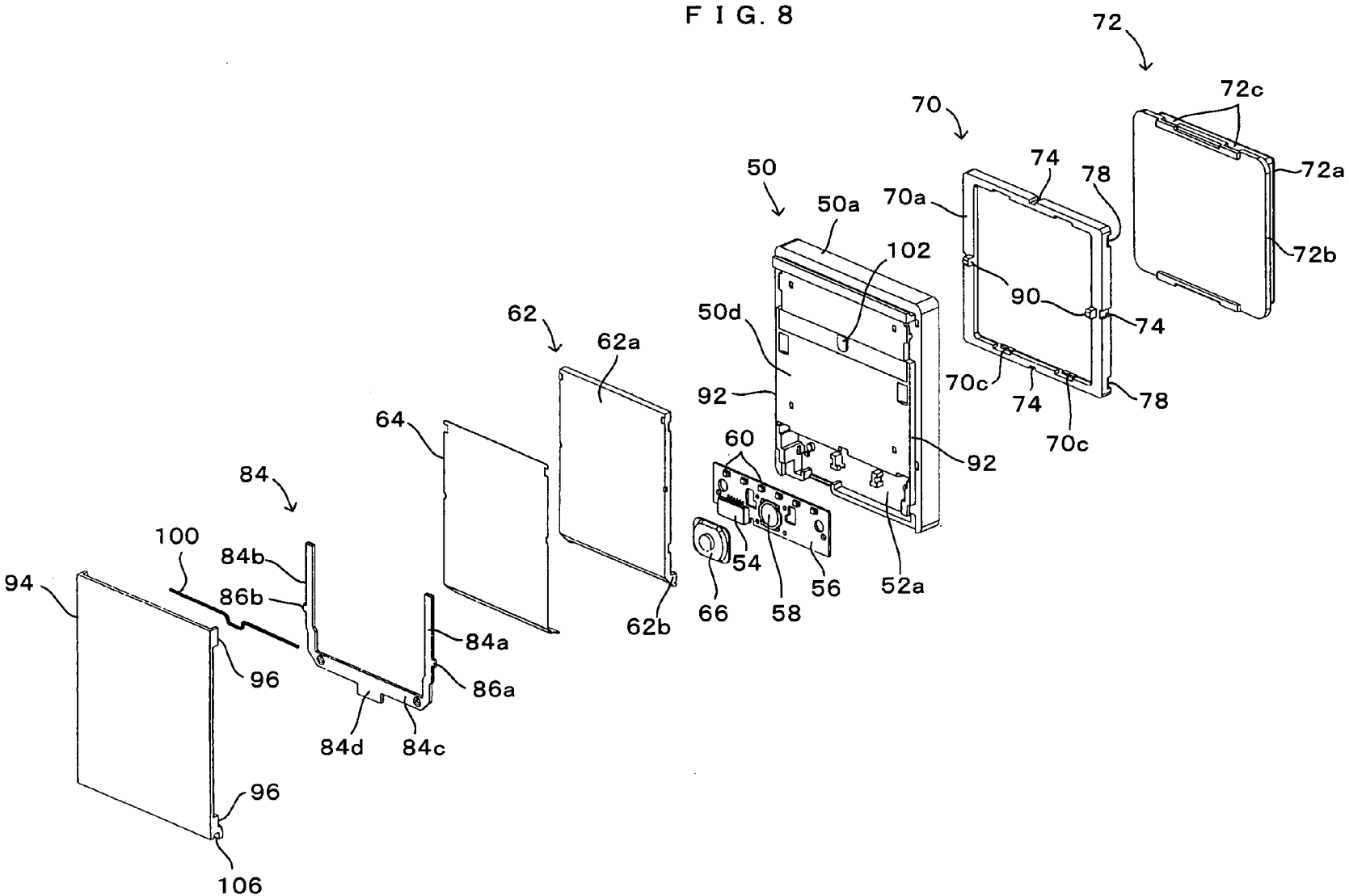
FIG. 8 is a disassembled perspective view of the one embodiment obliquely seen from down below.
Figure 9:
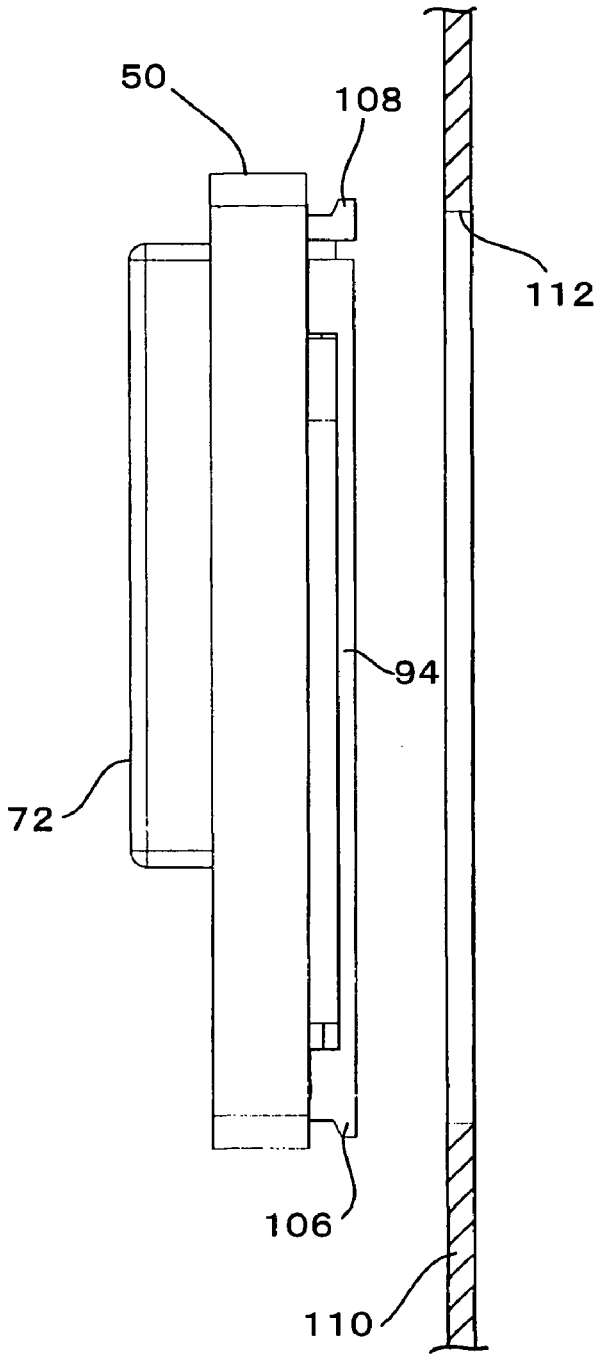
FIG. 9 is a diagram explaining amounting operation of the one embodiment in one state.
Figure 10:
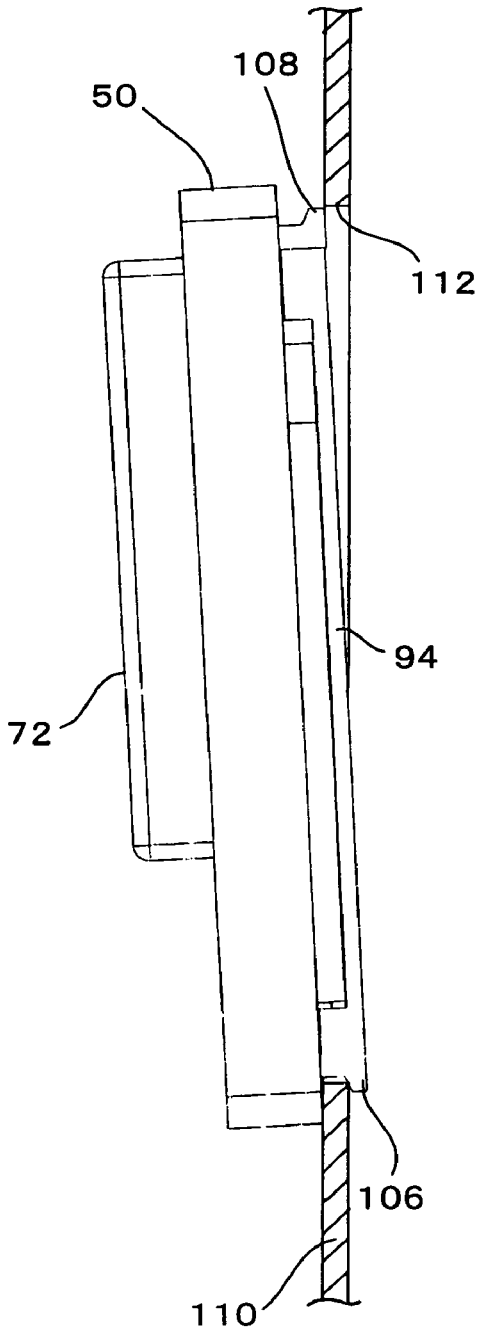
FIG. 10 is a diagram explaining the mounting operation of the one embodiment in a different state.
Figure 11:
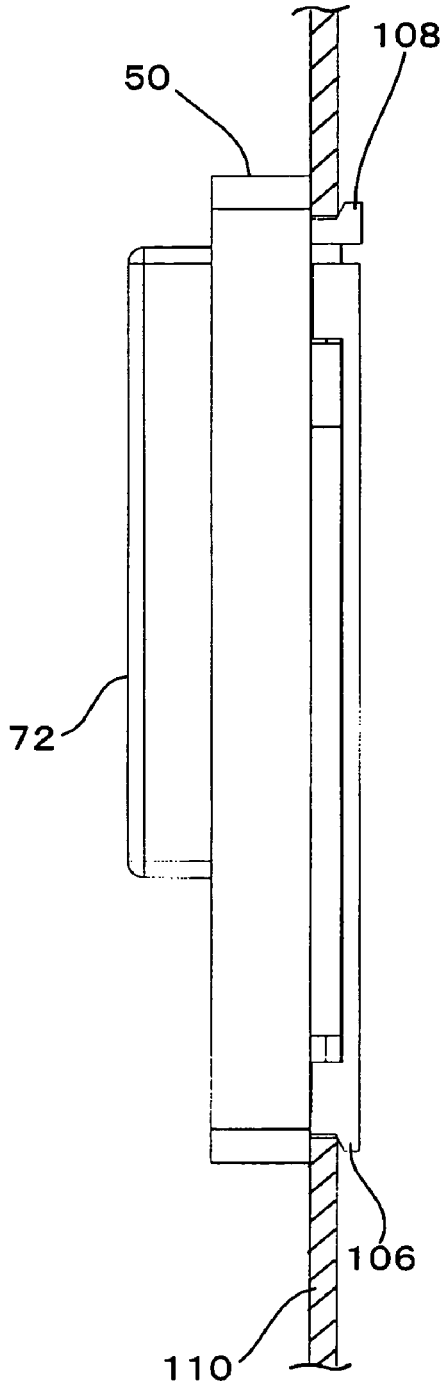
FIG. 11 is a diagram explaining the mounting operation of the one embodiment in a further different state.
Figure 12:
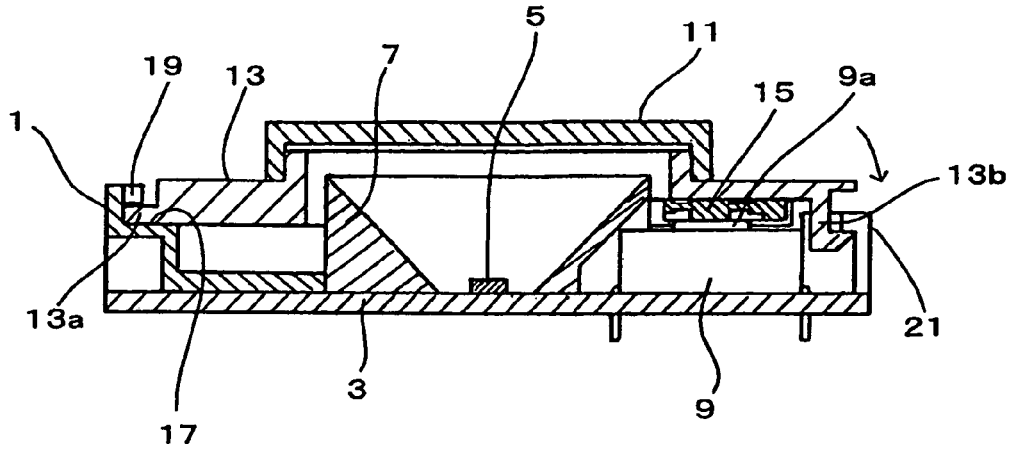
FIG. 12 is a sectional view showing related art.

One embodiment of the invention will hereinbelow be described with reference to FIG. 1 to FIG. 11. FIG. 1 is an external perspective view. FIG. 2 is a plan view. FIG. 3 is a right side view of a section taken on the line X-X in FIG. 2. FIG. 4 is a right side view of a section taken on the line Y-Y in FIG. 2. FIG. 5 is a plan view showing an internal structure removed of a push button section. FIG. 6 is a plan view showing the internal structure of FIG. 5 further removed of an operation body. FIG. 7 is a disassembled perspective view obliquely seen from up above. FIG. 8 is a disassembled perspective view obliquely seen from down below. FIG. 9 to FIG. 11 are diagrams each explaining a mounting operation of a push button switch device in each different state.

<Arrangement>

The push button switch device according to the embodiment has an arrangement shown in FIG. 1 to FIG. 8. The push button switch device according to the embodiment comprises a switch case 50 formed from a resin material. The switch case 50 comprises: a rectangular frame 50*a*; a partitioning plate 50*b* which is formed integrally with an upper side of the frame 50*a* in proximity to a front end thereof, which partitions the interior of the frame 50*a* into front and rear spaces and which is substantially half the height of the frame 50*a*; a first cover plate 50*c* for closing an upper side of the front space defined by the partitioning plate 50*b*; and a second cover plate 50*d* for closing a lower side of a space excluding the front space defined by the partitioning plate 50*b* and extending from place forward of the middle of the frame to a rear end thereof.

A transversely elongated rectangular space as seen in plan is defined in the frame 50*a* at the front end thereof and by the frame 50*a*, the partitioning plate 50*b* and the first cover plate 50*c*. This rectangular space is used as an installation space 52*a* for a printed wiring board to be described hereinlater. A generally square space as seen in plan is defined in the frame 50*a* and by the frame 50*a*, the partitioning plate 50*b* and the second cover plate 50*d*. The space extends from place forward of the middle of the frame to the rear end thereof and is used as an up/down movement space 52*b* for a push button section to be described hereinlater.

Disposed in the installation space 52*a* defined in the frame 50*a* at the front end thereof is a printed wiring board 56 on which a variety of circuit devices are mounted, the circuit devices including a semiconductor integrated circuit 54 for on/off control of a light emitting device to be described hereinlater. A tact switch 58 is mounted substantially centrally of the printed wiring board 56. The printed wiring board 56 is installed in a manner to present its back side to a lower face of the first cover plate 50*c*. The tact switch 58 is located on a lower face of the printed wiring board 56 thus installed. In this state, the tact switch 58 is pressed upward by an operation force of above a predetermined value specific to the switch whereby the tact switch 58 is turned on.

An array of six light emitting diodes (hereinafter, referred to as "LED") 60 as light emitting devices (the number of which is not limited to six) is mounted on the installed printed wiring board 56 at a rear end of the lower face thereof. An optical guiding member 62 formed from a transparent material such as an acrylic resin and having a generally L-shaped section guides light from these LEDs 60 to a push button section 72 (to be described hereinlater) disposed in the movement space 52*b*.

As shown in FIG. 3, in particular, the optical guiding member 62 comprises a flat base portion 62*a* having a smaller width than a transverse width of the movement space 52*b*; and a bent portion 62*b* bending upwardly substantially at 90° from a front end of the base portion 62*a*. An upper end face of the bent portion 62*b* is shaped like wave so as to be in proximity to the respective LEDs 60 for efficient light guidance. A boundary between the base portion 62*a* and the bent portion 62*b* defines a deflecting slope 62*c* which substantially forms an angle of 45° relative to the respective portions 62*a*, 62*b*. The base portion 62*a* is introduced into the movement space 52*b* as extending from the installation space 52*a*, under the partitioning plate 50*b* and along the second cover plate 50*d*. Thus, the optical guiding member 62 is disposed in the frame 50*a* while a rear side of the bent portion 62*b* abuts against and locks to a front side of the partitioning plate 50*b*. Six crests on the upper end face of the bent portion 62*b* are spaced close to the respective LEDs 60 in face-to-face relation.

When the light from the respective LEDs 60 enters the bent portion 62*b* via the closely spaced portions of the upper end face of the bent portion 62*b*, the light is reflected by the slope 62*c* so as to be substantially deflected through 90°. Thus, the light from the respective LEDs 60 is scattered along the plane of the base portion 62*a* whereby the pushbutton section 72 above the base portion is illuminated from below to indicate or inform that the tact switch 58 is brought into an on-state by pressing down the push button section 72. The optical guiding member 62 is provided with a white reflection sheet 64 on a lower face thereof for enhancing the illumination effect of the respective LEDs 60 on the push button section 72.

A flexible rubber body 66 shaped like a square as seen in plan is attached to the tact switch 58 mounted on the printed wiring board 56 in a manner to cover a lower face of the tact switch. A downward force combining a restoring force of the rubber body 66 and the operation force on the tact switch 58 acts as an upward urging force on the push button section 72 applied by means of a pressing body 84 to be described hereinlater. Namely, the rubber body 66 and the tact switch 58 act as urging means for the pressing body 84. Thus is negated the need for providing independent urging means such as a spring for urging the push button section 72. This results in the reduction of components.

An operation body 70 generally defining a square frame is vertically movably disposed in the movement space 52*b* defined in the frame 50*a* and extending from place forward of the middle of the frame 50*a* to the rear end thereof. The push button section 72 generally having a square shape in plan and formed from a transparent resin is removably mounted in the operation body 70.

The operation body 70 comprises a frame section 70*a*, and a step section 70*b* which is formed by evenly cutting away an inner periphery of an upper side of the frame section 70*a*, thus extending along the inner periphery of the frame section 70*a*. The push button section 72 comprises a pressing operation portion 72*a* projecting upward relative to the operation body 70, and a flange 72*b* formed integrally with a periphery thereof. Claws 70*c* formed on the inner periphery of the frame section 70*a* of the operation body 70 engage with a plurality of notches 72*c* formed in an upper face of the flange 72*b* whereby the push button section 72 is removably mounted in the operation body 70. The operation body 70 is moved up or down in the frame 50*a* as interlocked with a pressing operation of the pressing operation portion 72*a* of the push button section 72.

The respective sides of the frame section 70*a* of the operation body 70 are formed with vertical guide grooves 74 intermediately of outside surfaces thereof. An inner periphery of the frame 50*a* defining the movement space 52*b* is formed with guiding ribs 76 at front, rear, right and left places in correspondence to the respective guide grooves 74. The frame section 70*a* of the operation body 70 is formed with a total number of four engageable recesses 78 which are formed by cutting away respective portions of front and rear ends of upper outside surfaces of the left and right sides thereof. The inner periphery of the frame 50*a* defining the movement space 52*b* is formed with downward engaging claws 80 on lateral sides thereof in correspondence to the respective engageable recesses 78. When the operation body 70 is inserted in the movement space 52*b* by flexing each of the lateral sides thereof each time, the guiding ribs 76 are fitted in the guide grooves 74 while the respective engaging claws 80 are engaged with the respective engageable recesses 78. Thus, the operation body 70 is vertically movably mounted in the movement space 52*b*, as inhibited from escaping upwardly.

As described above, the downward force combining the restoring force of the rubber body 66 and the operation force on the tact switch 58 is applied as the upward urging force to the push button section 72 and the operation body 70 by means of the pressing body 84 to be described hereinlater. When the push button section 72 mounted in the operation body 70 is pressed down against this urging force, the operation body 70 operates simultaneously with the pressing operation of the push button section 72 so that a pressed portion of the operation body 70 is rotated downward about a center of rotation defined by one of the engageable recesses that corresponds to the pressed portions of the operation body 70 and the push button section 72 and by one of the engaging claws 80 that is engaged therewith.

If a forward right end of the push button section is pressed down, for example, the rearward left engageable recess 78 and the engaging claw 80 engaged therewith serve as the center of rotation. If a rearward left end of the push button section 72 is pressed down, the forward right engageable recess 78 and the engaging claw 80 engaged therewith serve as the center of rotation. If the push button section 72 is pressed down on the center of the left side thereof, the opposite engageable recesses 78 on the right side and the engaging claws 80 engaged therewith serve as the center of rotation. If the push button section 72 is pressed down on the center of the right side thereof, the opposite engageable recesses 78 on the left side and the engaging claws 80 engaged therewith serve as the center of rotation. Thus, the center of rotation of the operation body 70 is changed in accordance with the pressed portion of the operation body 70 which is pressed by means of the push button section 72.

As shown in FIG. 7 and FIG. 8, the pressing body 84 having a U-shape in plan is disposed under the operation body 70 in the movement space 52*b*. As shown in FIG. 5 and FIG. 6, left and right sides 84*a*, 84*b* of the pressing body 84 are located under the lateral sides of the operation body 70 and substantially extend from respective mid portions thereof to the front end. As shown in FIG. 3, a front side 84*c* bridging the left and right sides 84*a*, 84*b* of the pressing body 84 is inserted in the installation space 52*a*. A rectangular operation section 84*d* integrally extended from the center of the front end of the front side 84*c* abuts against a lower face of a central projection of the rubber body 66.

The left and right sides 84*a*, 84*b* of the pressing body 84 are integrally formed with respective contact sections 86*a*, 86*b* which project substantially halfway outward from the respective sides 84*a*, 84*b*. The frame 50*a* of the switch case 50 disposed under the contact sections 86*a*, 86*b* is integrally formed with step sections 88 which protrude upwardly from the upper side thereof to define respective projections serving as support points to support the pressing body 84. Contact sections 90 projecting downward from respective mid portions of the laterally lower sides of the operation body 70 abut against upper sides of the rear ends of the left and right sides 84*a*, 84*b* of the pressing body 84.

The pressing body 84 functions as a lever which has support points at the contact sections 86*a*, 86*b* in contact with the lateral step sections 88, power points at the rear ends of the left and right sides 84*a*, 84*b* of the pressing body 84 in contact with the lateral contact sections 90, and a working point at the operation section 84*d* in contact with the rubber body 66. When the push button section 72 is depressed to rotate downward a portion of the operation body 70 that corresponds to the pressed portion of the push button section, the opposite contact sections 90 of the operation body 70 press down the rear ends of the left an right sides 84*a*, 84*b* of the pressing body 84, whereby the operation section 84*d* on the opposite side of the contact sections 86*a*, 86*b* as the support points from the power points is pushed upward to press the tact switch 58 via the rubber body 66 against the restoring force and operation force. Hence, the tact switch 58 is turned on. The embodiment is arranged such that the contact sections 86*a*, 86*b* of the pressing body 84 abut against the lateral step sections 88, thus constituting the support points. Alternatively, the contact sections 86*a*, 86*b* may be omitted and the left and right sides 84*a*, 84*b* of the pressing body 84 may directly abut against the lateral step sections 88 at mid portions of the lower sides thereof.

The power points of the pressing body 84 are designed to be substantially aligned with the centers of the push button section 72 and the operation body 70 as seen in plan view. Thus is provided the substantially constant operating load on the power points of the pressing body 84 whatever part of the pushbutton section 72 is pressed down.

The operating load exerted on the power points of the pressing body 84 can be changed as desired if the support points of the pressing body 84 or the positions where the pressing body 84 abuts against the lateral step sections 88 are shifted toward the power points or the working point. The resultant force of the operation force on the tact switch 58 which is to be applied to the working point and the restoring force of the rubber body 66 is constant. If the support points are shifted toward the power points, for example, a greater load is required for providing the operating load to overcome the resultant force of the operation force on the tact switch 58 and the restoring force of the rubber body 66. Conversely if the support points are shifted toward the working point, a smaller load is needed to provide the operating load to overcome the resultant force of the operation force on the tact switch 58 and the restoring force of the rubber body 66.

As shown in FIG. 8, in particular, the second cover plate 50*d* on the lower side of the switch case 50 is formed with rib bodies 92 extending in a front-rear direction and projecting outwardly of the lateral ends thereof. Front-rear guide passages are defined between these front-rear rib bodies 92 and the lateral sides of the frame 50*a*.

As shown in FIG. 3 and FIG. 4, a backside cover 94 is provided on the lower side of the switch case 50 for covering the lower side thereof. The backside cover 94 is integrally formed with inwardly hooked engaging bodies 96 at respective front and rear positions of the left and right ends thereof. The hooked engaging bodies 96 are slidably movable along the guide passages. Thus, the backside cover 94 is removably mounted to the switch case 50 as covering the lower side thereof.

An accommodating section 98 comprising a rectangular recess and transverse linear grooves, as shown in FIG. 7, is formed in an upper side of the backside cover 94 at a rear end portion thereof. A wire spring 100 as an urging body bent forwardly at its mid portion in an open-ended rectangular shape is received by the accommodating section 98 in a manner that the wire spring with its opposite ends locked to places is allowed to move forward or rearward at its mid portion. As shown in FIG. 8, the second cover plate 50*d* is integrally formed with an engaging projection 102 projecting downward from a lower side of a rear end thereof. The intermediate bent portion of the wire spring 100 is brought in from the front side to abut against the engaging projection 102 whereby the backside cover 94 is slidably mounted to the lower side of the switch case 50 as urged forwardly by the wire spring 100. Particularly, the rearward right and left hooked engaging bodies 96 and the frame 50*a* adopt a locking structure based on concave-convex combination in order to ensure that the backside cover 94, which is not urged forwardly by the wire spring 100, does not disengage from the switch case 50 and is easily brought into sliding movement.

A first hook body 106 for mounting/retaining switch which is directed forward and transversely elongated is integrally extended from a front end of a lower face of the backside cover 94. A second hook body 108 for mounting/retaining switch which is directed rearward and transversely elongated is integrally extended from the lower side of the rear end of the frame 50*a* of the switch case 50.

The assembled push button switch device may be mounted to a mounting position of a predetermined fixing member as follows. As shown in FIG. 9 to FIG. 11, a mounting hole 112 generally having the same rectangular configuration as that of the switch case 50 is formed in a fixing member 110. When the switch cover 50 with the first hook body 106 locked to the mounting hole 112 is pulled forward, as shown in FIG. 10, the backside cover 94 is slidably moved rearwardly relative to the switch case 50 against the urging force of the wire spring 100. Hence, a distance between these hook bodies 106, 108 is reduced so that the second hook body 108 can be locked to the mounting hole 112.

Subsequently when the switch cover 50 is released from the forward pulling force, the urging force of the wire spring 100 slidably moves the backside cover 94 forwardly relative to the switch case 50 so that the backside cover is returned to its initial position. Thus, the push button switch device is mounted in the mounting hole 112 of the fixing member 110 as shown in FIG. 11.

<Center Pressing Operation>

Next, a detailed description is made on a specific operation of the push button switch device operated by pressing the push button section 72. It is noted that the operation body 70 is interlocked with the pressing operation of the push button section 72. In the following description on the operation, therefore, the pressed portion of the push button section 72 is regarded as the same as the pressed portion of the operation body 70.

In a case where the push button switch device having the above-described arrangement is applied to a start switch for activating an apparatus and an operator pressingly operates the push button section 72, the operation body 70 is pressed down against the urging force provided by the operation force on the tact switch 58 and by the restoring force of the rubber body 66. Hence, the contact sections 90 of the operation body 70 press down the rear ends of the left and right sides 84*a*, 84*b* of the pressing body 84, which lifts up the operation section 84*d* at the front end thereof as fulcrumed on the contact sections 86*a*, 86*b* in contact with the lateral step sections 88. Thus, the tact switch 58 is turned on as depressed via the rubber body 66 against the restoring force and the operation force.

At this time, the tact switch 58 is turned on to activate the individual LEDs 60, the light from which is guided to the push button section 72 by the optical guiding member 62. The individual LEDs 60 are maintained in the ON-state till predetermined conditions are established (the apparatus is brought into a predetermined state after the operation of the switch, for example). Thus, the push button section 72 is illuminated to allow the operator to visually recognize that the tact switch 58 is turned on.

When a central B-portion of the push button section 72 shown in FIG. 2 is pressed down, the pressing force on the push button section 72 is substantially transmitted to a central area of the operation body 70. At this time, the operation body 70 is not supported by any of the engagement portions between the engaging claws and the engageable recesses 78 but is translated downward against the upward urging force provided by the restoring force of the rubber body 66 and the operation force on the tact switch 58. Hence, the pressing force on the push button section 72 is directly transmitted to the opposite contact sections 90 located substantially centrally of the operation body 70. It is noted here that a reaction force that the depressed operation body 70 receives via the contact sections 90 is a force which combines the restoring force of the rubber body 66 and the operation force on the tact switch 58 and which is transmitted via the pressing body 84. This force is equivalent to the operating load.

As a result, the rear ends of the pressing body 84 are pressed down by the contact sections 90 of the operation body 70. As fulcrumed on the contact sections 86*a*, 86*b* in contact with the lateral step sections 88, the pressing body 84 lifts up the operation section 84*d* at the front end thereof, as described above, whereby the tact switch 58 is depressed and turned on.

<End Pressing Operation>

When an A-portion leftward of the central B-portion of the push button section 72 shown in FIG. 2 is pressed down, the pressing force on the push button section 72 is transmitted to a left end area of the operation body 70. Hence, the left end of the operation body 70 is rotated downward about engagement portions P1, P2 between the right-hand engaging claws 80 and engageable recesses 78 against the urging force applied to the left end of the operation body 70 via the left side 84*a* of the pressing body 84. Thus, the left end of the operation body 70 is moved down.

The downward movement of the left end of the operation body 70 particularly causes the left-hand contact section 90 of the operation body 70 to press down hard on the left side 84*a* of the pressing body 84. However, the pressing body 84 per se has a certain degree of rigidity so that the right side 84*b* of the pressing body 84 is similarly pressed down although the left side 84*a* thereof is pressed down.

As a result, the pressing body 84, fulcrumed on the contact sections 86*a*, 86*b* in contact with the lateral step sections 88, lifts up the operation section 84*d* at the front end thereof as in the case where the central B-portion of the push button section 72 is pressed down. Thus, the tact switch 58 is turned on as depressed via the rubber body 66 against the restoring force and the operation force.

On the other hand when a C-portion rightward of the central B-portion of the push button section 72 shown in FIG. 2 is pressed down, the pressing force on the push button section 72 is transmitted to a right end area of the operation body 70. Hence, the right end of the operation body 70 is rotated downward about engagement portions P3, P4 between the left-hand engaging claws 80 and engageable recesses 78 against the urging force applied to the right end of the operation body 70 via the right side 84*b* of the pressing body 84. Thus, the right end of the operation body 70 is moved down.

The downward movement of the right end of the operation body 70 particularly causes the right-hand contact section 90 of the operation body 70 to press down hard on the right side 84*b* of the pressing body 84. However, the pressing body 84 per se has a certain degree of rigidity so that the left side 84*a* of the pressing body 84 is similarly pressed down by pressing down on the right side 84*b* thereof. As a result, the pressing body 84, fulcrumed on the contact sections 86*a*, 86*b* in contact with the lateral step sections 88, lifts up the operation section 84*d* at the front end thereof as in the case where the central B-portion of the push button section 72 is pressed down. Thus, the tact switch 58 is turned on as depressed via the rubber body 66 against the restoring force and the operation force.

If an operating load provided by pressing on the A-portion of the push button section 72 is compared with an operating load provided by pressing on the C-portion thereof, there is little difference between the operating loads provided by pressing on the A-portion of the push button section 72 and by pressing on the C-portion thereof because distances from the A-portion to the support points P1, P2 are substantially equal to distances from the C-portion to the support points P3, P4 and because a reaction force applied to the operation body 70 in conjunction with pressing on the A-portion of the push button section 72 is substantially equal to a reaction force applied to the operation body 70 in conjunction with pressing on the C-portion thereof.

If an operating load provided by pressing on the B-portion of the push button section 72 is compared with the operating load provided by pressing on the A-portion (or C-portion) thereof, there is a minor difference between these operating loads because the reaction force applied to the operation body 70 in conjunction with pressing on the B-portion of the push button section 72 does not differ so much from the reaction force applied to the operation body 70 in conjunction with pressing on the A-portion (or C-portion) thereof. The difference between these operating loads is not so great as a difference between operating loads, which is encountered by the conventional device having one support point to support the operated push button, the operation loads provided by pressing on a portion far from the support point and by pressing on a portion close to the support point.

Therefore, the operating loads provided by pressing on the B-portion and by pressing on the A-portion (or C-portion) of the push button section 72 do not differ so much as to make the operator feel odd. The embodiment substantially provides the constant operating load.

When the push button section 72 shown in FIG. 2 is pressed down on an E-portion rearward of the central B-portion thereof, the pressing force on the pushbutton section 72 is transmitted to a rear end area of the operation body 70. Hence, the rear end of the operation body 70 is rotated downward about the forward ones P2, P4 of the engagement portions between the engaging claws and the engageable recesses 78, as the center of rotation, and against the upward urging force provided by the restoring force of the rubber body 66 and the operation force on the tact switch 58. Thus, the rear end of the operation body 70 is moved down.

Due to the downward movement of the rear end of the operation body 70, the pressing body 84 is fulcrumed on the contact sections 86*a*, 86*b* in contact with the lateral step sections 88 so as to lift up the operation section 84*d* at the front end thereof. Thus, the operation section pressingly turns on the tact switch 58.

On the other hand, when the push button section 72 shown in FIG. 2 is pressed down on an H-portion forward of the central B-portion thereof, the pressing force on the push button section 72 is transmitted to a front end area of the operation body 70. Hence, the front end of the operation body 70 is rotated downward about the rearward ones P1, P3 of the engagement portions between the engaging claws 80 and the engageable recesses 78, as the center of rotation, and against the upward urging force provided by the restoring force of the rubber body 66 and the operation force on the tact switch 58. Thus, the front end of the operation body 70 is moved down.

Due to the downward movement of the front end of the operation body 70, the pressing body 84 is fulcrumed on the contact sections 86*a*, 86*b* in contact with the lateral step sections 88 so as to lift up the operation section 84*d* at the front end thereof. Thus, the operation section pressingly turns on the tact switch 58.

If an operating load provided by pressing on the E-portion of the push button section 72 is compared with an operating load provided by pressing on the H-portion thereof, there is little difference between the operating loads provided by pressing on the E-portion of the push button section 72 and by pressing on the H-portion thereof because distances from the E-portion to the support points P2, P4 are substantially equal to distances from the H-portion to the support points P1, P3 and because a reaction force applied to the operation body 70 in conjunction with pressing on the E-portion of the push button section 72 is substantially equal to a reaction force applied to the operation body 70 in conjunction with pressing on the H-portion thereof.

If the operating load provided by pressing on the B-portion of the push button section 72 is compared with the operating load provided by pressing on the E-portion (or H-portion) thereof, there is a minor difference between these operating loads because the reaction force applied to the operation body 70 in conjunction with pressing on the B-portion of the push button section 72 does not differ so much from the reaction force applied to the operation body 70 in conjunction with pressing on the E-portion (or H-portion) thereof. The difference between these operating loads is not so great as the difference between the operating loads, which is encountered by the conventional device having one support point to support the operated push button, the operation loads provided by pressing on the portion far from the support point and by pressing on the portion close to the support point.

Therefore, the operating loads provided by pressing on the B-portion and by pressing on the E-portion (or H-portion) of the push button section 72 do not differ so much as to make the operator feel odd. The embodiment substantially provides the constant operating load.

<Corner Pressing Operation>

When the push button section 72 shown in FIG. 2 is pressed down on a D-portion at a rearward-left end thereof, the pressing force on the push button section is transmitted to a rearward-left end area of the operation body 70. Hence, the rearward-left end of the operation body 70 is rotated downward about the forward one P2 of the engagement portions between the engaging claws 80 and the engageable recesses 78, as the center of rotation, and against the upward urging force applied to the rearward-left end of the operation body 70 via the left side 84*a* of the pressing body 84. Thus, the rearward-left end of the operation body 70 is moved down.

When the push button section 72 shown in FIG. 2 is pressed down on an F-portion at a rearward-right end thereof, the pressing force on the push button section 72 is transmitted to a rearward-right end portion of the operation body 70. Hence, the rearward-right end of the operation body 70 is rotated downward about the forward-left one P4 of the engagement portions between the engaging claws 80 and the engageable recesses 78, as the center of rotation, and against the urging force applied to the rearward-right end of the operation body 70 via the right side 84*b* of the pressing body 84. Thus, the rearward-right end of the operation body 70 is moved down.

When the push button section 72 shown in FIG. 2 is pressed down on a G-portion at a forward-left end thereof, the pressing force on the push button section 72 is transmitted to a forward-left end portion of the operation body 70. Hence, the forward-left end of the operation body 70 is rotated downward about the rearward-right one P1 of the engagement portions between the engaging claws 80 and the engageable recesses 78, as the center of rotation, and against the urging force applied to the forward-left end of the operation body 70 via the left side 84*a* of the pressing body 84. Thus, the forward-left end of the operation body 70 is moved down.

When the push button section 72 shown in FIG. 2 is pressed down on an I-portion at a forward-right end thereof, the pressing force on the push button section 72 is transmitted to a forward-right end portion of the operation body 70. Hence, the forward-right end of the operation body 70 is rotated downward about the rearward-left one P3 of the engagement portions between the engaging claws 80 and the engageable recesses 78, as the center of rotation, and against the urging force applied to the forward-right end of the operation body 70 via the right side 84*b* of the pressing body 84. Thus, forward-right end of the operation body 70 is moved down.

Since the pressing body 84 per se has a certain degree of rigidity, the downward movement of any one of the rearward-left end, rearward-right end, forward-left end and forward-right end of the operation body 70 causes the pressing body 84 to be bodily pressed down as in the case where the push button section 72 shown in FIG. 2 is pressed down on the A- or C-portion thereof. As a result, the pressing body 84 is fulcrumed on the contact sections 86*a*, 86*b* in contact with the lateral step sections 88 so as to lift up the operation section 84*d* at the front end thereof as in the case where the central B-portion of the push button section 72 is pressed down. Thus, the tact switch 58 is turned on as pressed down via the rubber body 66 against these restoring force and operation force.

If an operating load provided by pressing on the D-portion of the push button section 72 is compared with an operating load provided by pressing on the F-portion thereof, there is little difference between the operating loads provided by pressing on the D-portion of the push button section 72 and by pressing on the F-portion thereof because a distance from the D-portion as the pressed portion to the support point P2 is substantially equal to a distance from the F-portion as the pressed portion to the support point P4 and because a reaction force applied to the operation body 70 in conjunction with pressing on the D-portion of the push button section 72 is substantially equal to a reaction force applied to the operation body 70 in conjunction with pressing on the F-portion thereof.

If the operating load provided by pressing on the B-portion of the push button section 72 is compared with the operating load provided by pressing on the D-portion (or the F-portion) thereof, there is a minor difference between these operating loads because the reaction force applied to the operation body 70 in conjunction with pressing on the B-portion of the push button section 72 does not differ so much from the reaction force applied to the operation body 70 in conjunction with pressing on the D-portion (or F-portion) thereof. The difference between these operating loads is not so great as the difference between the operating loads, which is encountered by the conventional device having one support point to support the operated push button, the operation loads provided by pressing on the portion far from the support point and by pressing on the portion close to the support point.

Therefore, the operating loads provided by pressing on the B-portion and by pressing on the D-portion (or F-portion) of the push button section 72 do not differ so much as to make the operator feel odd. The embodiment substantially provides the constant operating load.

The operating loads provided by pressing on the G-portion of the push button section 72 and by pressing on the I-portion thereof are substantially the same for the same reason as in the case of the operating loads provided by pressing on the D-portion of the push button section 72 and by pressing on the F-portion thereof. For the same reason as in the case of the operating loads provided by pressing on the B-portion of the push button section 72 and by pressing on the D-portion (or F-portion) thereof, the difference between the operating loads provided by pressing on the B-portion of the push button section 72 and by pressing on the G-portion (or I-portion) thereof is not so great as to make the operator feel odd. Namely, substantially the same operating loads are provided.

<Variable Setting of Operating Load>

As described above, such an operating load can be changed as desired by properly shifting the support points of the pressing body 84. The resultant force of the operation force on the tact switch 58 and the restoring force of the rubber body 66, which is to be applied to the working point of the pressing body 84, is constant. Therefore, if the operator wants to increase the operating load from the present level, for example, the support points may be shifted toward the power points. If the operator wants to decrease the operating load from the present level, for example, the support points may be shifted toward the working point. The operating load can be changed in a very wide range (in both a range above the resultant force and a range below the resultant force) by shifting the support points. The position of the support point can be adjusted by cutting away or depositing the step section 88.

The opposite step sections 88 serving as the support points may preferably be provided on the switch case 50 in a manner that the step sections 88 can be shifted freely in the fore-aft direction and can be fixed to any place between the power point and the working point. To illustrate, the switch case 50 may be provided with slide grooves in the fore-aft direction thereof, while the step sections may be supported by a support mechanism for simultaneous sliding movement along the slide grooves. Lock portions may be provided at some places on the slide grooves such that the support mechanism may be locked to any one of the lock portions for fixing the step sections to place.

According to the above-described embodiment, the position of the engagement portion as the center of rotation of the operation body 70 can be changed according to the pressed portion of the push button section 72. Therefore, even when the push button section 72 is pressed down on the end or the corner (other than the central portion) thereof, the resultant operating load can be made substantially equal to the operating load provided by pressing on the center of the push button section. The embodiment is adapted to substantially equalize the operating load irrespective of the pressed portion of the push button section 72.

The resultant force of the operation force on the tact switch 58 and the restoring force of the rubber body 66 is used as the urging force applied to the operation body 70 by means of the pressing body 84. This negates the need for providing special means such as a spring for urging the operation body 70. Accordingly, the device can achieve the reduction of components and be manufactured at low cost.

Further, the switch operating load can be changed by properly shifting the support points of the pressing body 84. It is therefore easy to make the variable setting of the operating load according to operator's preferences or use conditions of the push button switch device.

When the push button section 72 continues to be pressed down, there may be a situation where the pressing body 84 continues to receive a heavy load on the rear ends of the left and right sides 84*a*, 84*b* thereof via the operation body 70 while the operation section 84*d* at the front end thereof continues to abut against the tact switch 58. To illustrate, assume a push button switch device having an arrangement wherein the pressing body is shaped like a rectangular frame. When the push button section continues to be pressed down, the pressing body having the rectangular frame configuration abuts against the built-in switch and the like at the opposite ends thereof so as to be prevented from being further pressed down while the heavy load continues to be applied to the mid portion of the rectangular frame of the pressing body. That is, this push button switch device has a so-called center impeller configuration wherein the pressing body receives the load on the mid portion thereof, as supported at the opposite ends thereof. However, the pressing body 84 of the above-described embodiment has a so-called cantilever configuration wherein the pressing body 84 receives the load on the rear ends thereof (the rear ends of the left and right sides 84*a*, 84*b*) as supported by the step sections 88. Hence, the load exerted on the whole body of the pressing body 84 is reduced notably. As a result, the pressing body 84 can achieve an extended service life, contributing to the extended service life of the switch device as a whole.

Further, the embodiment has the arrangement wherein the individual LEDs 60 are mounted on the same printed wiring board 66 that is provided with the tact switch 58 and wherein the light from the individual LEDs 60 is led to the push button section 72 by means of the optical guiding member 62. In contrast to an arrangement wherein the LEDs 60 are mounted to a circuit board other than that provided with the tact switch 58 and disposed under the push button section 72, or wherein the LEDs are disposed at place other than under the push button section 72 and away from the tact switch 58, the embodiment does not entail the size increase of the device. Thus is provided a push button switch device having a lower profile.

Further, the first hook body 106 is provided at the backside cover 94 while the second hook body 108 is provided at the switch case 50. With the backside cover 94 slidably moved relative to the switch case 50 against the urging force of the wire spring 100, the first hook body 106 can be brought into engagement with the predetermined place while the second hook body 108 can also be brought into engagement. Thus is facilitated the operation of mounting the push button switch device to the predetermined position and hence, quite an easy mounting operation of the switch device is provided.

The invention is not limited to the above-described embodiment and various changes and modifications other than the above may be made thereto without departing from the spirit of the invention.

In the above embodiment, the support points of the pressing body 84, for example, are constituted by the step sections 88 formed at the switch case 50. However, the step section 88 may be replaced by a projection or any other projected portion. Alternatively, the support point may comprise a projected portion formed at the pressing body 84 or a combination of the projected portion and a recess formed at the switch case 50.

While the above embodiment has been described by way of the case where the rubber body 66 and the tact switch 58 constitute the urging means for the pressing body 84, an elastic member such as a spring or any other rubber which is dedicated to urging the pressing body 84 may of course be provided as the urging means.

It is not particularly required to provide the rubber body 66 for applying the urging force to the operation body 70. An arrangement may also be made such that only the operation force on the tact switch 58 and the other switch is used for applying the upward urging force to the operation body 70 by means of the pressing body 84.

Although the above-described embodiment illustrates the switch case 50 and the operation body 70 having the rectangular configurations in plan view, it is a matter of course for these components to have a circular or any other symmetrical configuration. In this case, as well, the same effects as that of the above embodiment may be obtained.

While the above-described embodiment has the arrangement wherein the push button section 72 is removably mounted to the operation body 70, the operation body 70 may be integrated with the push button section 72.

Further, the push button switch device is not necessarily required to incorporate therein the light emitting devices such as the LEDs 60 and any other lamp, or the optical guiding member 62.

The switch element disposed in the switch case 50 is not limited to the tact switch 58 but may comprise any switch element capable of generating some sort of operation force. The switch element may be exemplified by a leaf switch. While the tact switch 58 of the above embodiment is illustrated as a so-called a-contact type which is turned on by pressing, the tact switch may also be a so-called b-contact type which is turned off by pressing.

The switch element may also be a noncontact switch rather than the contact type switch such as the tact switch 58. It is preferred in this case that a flexible member such as the rubber body 66 is provided so as to use the restoring force of the flexible member such as the rubber body 66 as the urging force applied to one end (the front end) of the pressing body 84.

The push button switch device according to the invention is applicable to start switches for activating apparatuses as described by way of the above embodiment. More specifically, the push button switch device of the invention is applicable to a start switch for copying machines, a variety of switches for electronic apparatuses which particularly incorporate therein the light emitting device for illumination indicative of ON/OFF state of the switch, and other low-profile operation switches.

The invention claimed is:

1. A push button switch device wherein a switch element switched on or off by a downward pressing operation of a push button section is disposed in a switch case as shifted toward a first end from the center of the push button section, the push button switch device comprising:

an operation body which is disposed in the switch case and is movable upward or downward as interlocked with the pressing operation of the push button section or with a releasing operation thereof, a plurality of engagement portions of which are formed on edges thereof and are engaged with edges of the switch case in order to prevent disengagement from the switch case, and a pressed portion of which is rotated downward about at least one of the engagement portions that corresponds to the pressed portion when the pressing operation is performed;

a pressing body which is disposed in the switch case at place under the operation body, which is oscillatably supported on a support point located at any position between first and second ends thereof for seesaw movement between the first and second ends thereof, and which presses the switch element by means of the first end thereof moved upward;

an urging element for urging downward the first end of the pressing body and for urging upward the second end thereof; and a contact section which abuts against the second end of the pressing body as formed substantially centrally of a lower side of the operation body, and which moves down the second end of the pressing body against the urging force of the urging element as driven by the downward movement of the operation body interlocked with the pressing operation of the push button section.

2. A push button switch device according to claim 1, wherein the urging element is the switch element and the urging force derives from an operation force on the switch element.

3. A push button switch device according to claim 1, wherein a flexible rubber body covering the switch element is interposed between the switch element and the first end of the pressing body and wherein the urging element is the rubber body and the urging force derives from a restoring force of the rubber body.

4. A push button switch device according to any one of claims 1 to 3, wherein a projection is provided at the switch case or the pressing body and the position of the projection defines the support point of the pressing body.

5. A push button switch device according to claim 4, wherein the position of the projection can be shifted in a direction toward the first end of the pressing body and in a direction toward the second end thereof and can be fixed to place.

6. A push button switch device according to any one of claims 1 to 3 wherein the operation body has a generally rectangular configuration and the plural engagement portions are formed at the four corners of the operation body.

7. A push button switch device according to any one of claims 1 to 3, further comprising a circuit board disposed in the switch case on a first-end side thereof and having the switch element and a light emitting device mounted thereon, and an optical guiding member for guiding light from the light emitting device to the push button section.

8. A push button switch device according to any one of claims 1 to 3, further comprising: a backside cover mounted to a back side of the switch case in a manner to be slidable in opposite directions parallel to the back side of the switch case and to be removable from the switch case; a first hook body for mounting/retaining switch device which is integrated with a first end of the backside cover with respect to a sliding direction thereof; a second hook body formed at a second end of the switch case with respect to the sliding direction; and an urging body disposed between the back side of the switch case and the backside cover and urging the backside cover relative to the switch case in one way of the sliding direction.

* * * * *